US007572964B2

(12) United States Patent
Sundby

(10) Patent No.: US 7,572,964 B2
(45) Date of Patent: Aug. 11, 2009

(54) GUITAR-SLIDE RING

(76) Inventor: Robert T. Sundby, 2400 W. Main, Suite A, Rapid City, SD (US) 57702

( * ) Notice: Subject to any disclaimer, the term of this patent is extended or adjusted under 35 U.S.C. 154(b) by 0 days.

(21) Appl. No.: 11/566,067

(22) Filed: Dec. 1, 2006

(65) Prior Publication Data

US 2008/0127801 A1 Jun. 5, 2008

(51) Int. Cl.
*G10D 3/00* (2006.01)

(52) U.S. Cl. ..... 84/315

(58) Field of Classification Search ..... 84/315–322
See application file for complete search history.

(56) References Cited

U.S. PATENT DOCUMENTS 5,856,627 A * 1/1999 George ..... 84/322
6,111,177 A * 8/2000 Pattillo ..... 84/315
2007/0137249 A1* 6/2007 Czajka et al. ..... 63/15.6

* cited by examiner

*Primary Examiner*—Kimberly R Lockett

(57) ABSTRACT

A device that allows a musician to conveniently play both slide guitar and traditional styles, that includes a ring-shape member to accurately receive the guitarists finger, upon which a second and wider half-cylindrical shaped bearing surface is attached via a tapered and joining rectangular base. The half-cylindrical bearing surface contacts with the string(s) of the instrument which vibrate against it. The device is constructed such that it also functions as jewelry, thereby being immediately accessible to the musician.

2 Claims, 1 Drawing Sheet

Figure 1
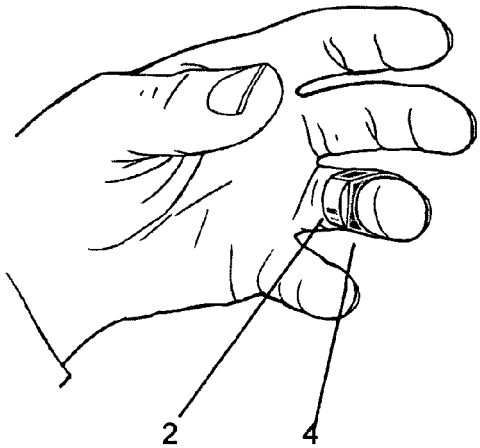
Figure 2
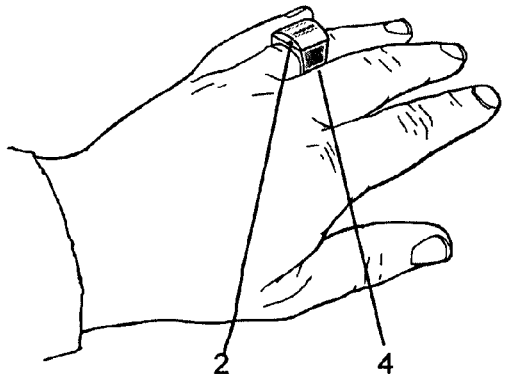
Figure 3
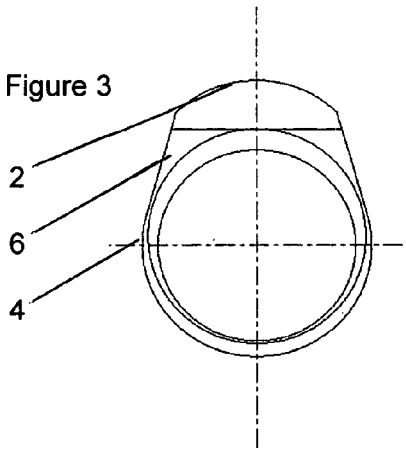
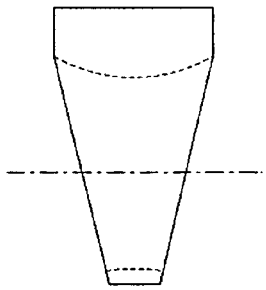
Figure 4

GUITAR-SLIDE RING

BACKGROUND OF THE INVENTION

1. Field of the Invention

The invention relates devices, or slides, that assist musicians playing stringed instruments, usually a guitar. A slide allows a musician to contact one or a plurality of strings to produce a completely different sound from the regular sounds of the instrument.

2. Description of the Prior Art

Traditional guitar slides are primarily cylindrical and made of brass, chrome or glass. Aspirin bottles or beer bottle necks have been used commonly as slides for the guitar. Glass offers a purer and cleaner sound, whereas metal or brass is more of a "dirty" or "blues" sound.

Slides have been used in both open and traditional tunings. A musician can use the slide for one or more notes at the same time. Lead guitarists learn the skill of muffling unwanted noise from un-played or unwanted strings. This is accomplished by dampening strings with parts of either hand, resulting in limited or multi strings resonating melodies or tones. Slides have historically consisted of various lengths (distance from end to end) and radii.

A full width slide generally accommodates the entire width of a guitar neck (most useful for open tunings, most commonly "Open G"). Less commonly used shorter lengths are less cumbersome and work for a limited number of strings. An aspirin bottle for example is shorter than a full length slide and therefore has these characteristics, relative to a full length slide.

Problems have always remained with the bulky masses that slides inherently are, which exclude the normal use of the guitarist's fretboard hand. One of the problems has been this: Either the guitarist is playing "regular" guitar or the guitarist is playing "slide" guitar. One method, or style, has unfortunately precluded the other. Guitarists have been forced to drop or throw slides to the ground in an attempt to quickly return to the "regular" guitar passage. Having the slide available immediately when and where needed is important. It is a major obstacle that performing guitarists don't generally have a convenient way to access and dispose of a slide while performing on stage.

One device, #4,790,232 by Rosen, attempts to solve this particular problem by providing a holding mechanism attached to the guitar for the guitar slide when not in use. Unfortunately, the process of placing and removing it is still a process and takes time. Valuable time is spent using it instead of seamlessly performing with the instrument. The device would also appear to require perhaps unwanted modifications to the instrument.

A number of slides are of shorter lengths and therefore less bulky than a full length slide. D360,647 by Jaminez does not allow for the fingers to fully bend and/or contact the fretboard when the slide is in playing position. This device also has to be spun around to the other side of the hand than the "backhand" or fingernail side shown. Lastly, it also does not function as wearable jewelry. Another design, #5,515,762, is also is of a shorter length but it does not allow for the player's actual fingertip to contact the string. Therefore the player's slide fingertip cannot be used for regular contact to the fretboard. A third device, #4,817,488 by De los Santos would either fall off the hand in the event of a finger spread or prevent the spread. Spreading the fingers, called a "stretch", is often required by guitar players. Furthermore, none of these designs are useful as jewelry which is both attractive and instantly accessible to the musician, nor do they eliminate the problems of the devices being cumbersome and ill-fitting. At best, they require adjustment between the fingertips contacting strings and the slide contacting strings. They don't allow for the "seamless" transition between the two styles.

Recorded guitar music tends to reflect the fact that guitarists are either playing a song without a slide, or they are playing a song with a slide. There's not much in between, because of the problems above.

SUMMARY OF THE INVENTION

Thus, the need for a slide has existed, which solves the historical problems as stated above. This invention does so by encompassing the following characteristics:

1. All fingers on the fretboard hand are allowed full fingertip contact by the all a custom fitted device via ring sizing
2. The musician now has an instantly accessible slide that doesn't need to be picked up or put down in the middle of a musical passage
3. The musician now has a device that requires no spinning or adjustment between playing chords (fingertips touching strings), or playing slide (slide touching string). This allows the guitarist increased freedom and the seamless transition between two styles of guitar playing.
4. A custom fitted slide, which eliminates the problem other slides have or being loose, bulky, cumbersome and needing continual adjustment.
5. Guitar slide consisting of a bearing-surface of cylindrical design composed of steel, brass, ceramic, porcelain, titanium, glass or colored glass surface or combination thereof.
6. A guitar slide which doesn't require adjustment or spinning 180 or any other degrees to switch from fingertip(s) contacting instrument or slide contacting instrument.
7. A slide which can receive a magnetic attachment consisting of a longer bearing cylindrical surface allowing more strings to be contacted with the slide.
8. An attractive piece of jewelry that accomplishes all of the above It is believed that this device can transform and help merge diverse guitar musical styles into a more broadened and encompassing style. It does this by increasing the accessibility of styles making various these styles immediately available at the guitarist's hand(s).

BRIEF DESCRIPTION OF THE DRAWINGS

FIG. 1: The device in playing position on the finger

FIG. 2: The device as jewelry, or non playing position

FIG. 3: View along the axis of the cylindrical ring-shape which accurately receives the finger, leaving the fingertip free to contact strings FIG. 4: View turned 90 degrees from the axis in FIG. 3

DESCRIPTION OF THE PREFERRED EMBODIMENTS

The unique design includes the shape of the bearing edge of the ring being a cylindrical surface, which touches the string(s) at a perpendicular tangent producing the resonating slide guitar sound. It also includes an appropriate base to support the above at an appropriate and natural distance to the string(s), relative to the size of the ring.

The material of the bearing surface can be any metal, glass, brass, porcelain or ceramic. A custom fitted glass piece or coating upon the ring produces the smoothest tone. Special high-strength or tempered glass is optimal. The bulk of the ring can also be any of the above, or hypo-allergenic titanium.

The length of the bearing cylinder section or slide part, bearing edge, is immaterial but typically wide enough to cover 2-3 strings, or common production widths being ⅜" to 1¼".

The ring is turned 180 degrees for playing position as shown in FIG. 1 and can remain there for all types of playing. Chords, regular lead playing or slide sounds can all be achieved when the ring is in this position. The fingers of the hand would be perpendicular to the strings during contact of the slide with the strings. The device can be worn below the middle of the finger or just above the middle part of the finger. FIG. 2 shows the slide, or jewelry, in non-playing position.

Other aspects of the ring's décor, such as the non-bearing surfaces, engravings etc., are immaterial and can vary widely.

I claim:

1. A slide ring for use with a stringed instrument comprising:

a ring which is capable of being placed upon any of an operator's fingers and the ring having a cylindrical surface on one edge of said ring, the cylindrical surface being capable of engaging at least one of the strings of a stringed instrument;

whereby the ring may be worn as a piece of jewelry when in one position on a finger and used as a stringed instrument slide when turned to another position on the finger.

2. A slide ring for use with a stringed instrument comprising:

(1) a ring which is capable of being placed upon any of an operator's fingers;

(2) the ring having a base on one edge of said ring such that the base protrudes outward from the center of said ring; and (3) a cylindrical surface affixed to said base such that the cylindrical surface protrudes outward from said base and said cylindrical surface being capable of engaging at least one of the strings of a stringed instrument;

whereby the ring may be worn as a piece of jewelry when in one position on a finger and used as a stringed instrument slide when turned to another position on the finger.

* * * * *